US010465262B2

(12) United States Patent
Nishizawa et al.

(10) Patent No.: US 10,465,262 B2
(45) Date of Patent: Nov. 5, 2019

(54) METHOD FOR COOLING STEEL STRIP AND COOLING APPARATUS

(71) Applicant: NIPPON STEEL & SUMITOMO METAL CORPORATION, Tokyo (JP)

(72) Inventors: Koichi Nishizawa, Tokyo (JP); Hiroshi Minehara, Tokyo (JP); Yasuhiro Mori, Tokyo (JP); Seiji Sugiyama, Tokyo (JP); Masafumi Matsumoto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 289 days.

(21) Appl. No.: 15/326,912

(22) PCT Filed: Feb. 23, 2015

(86) PCT No.: PCT/JP2015/055012
§ 371 (c)(1),
(2) Date: Jan. 17, 2017

(87) PCT Pub. No.: WO2016/013240
PCT Pub. Date: Jan. 28, 2016

(65) Prior Publication Data

US 2017/0211165 A1 Jul. 27, 2017

(30) Foreign Application Priority Data

Jul. 24, 2014 (JP) ..... 2014-150932

(51) Int. Cl.
*C21D 9/573* (2006.01)
*C21D 1/613* (2006.01)
(Continued)

(52) U.S. Cl.
CPC ..... *C21D 9/573* (2013.01); *C21D 1/613* (2013.01); *C21D 1/667* (2013.01); *C21D 9/5735* (2013.01);
(Continued)

(58) Field of Classification Search
CPC ..... C23C 2/28; C23C 2/06
See application file for complete search history.

(56) References Cited

U.S. PATENT DOCUMENTS

2011/0270433 A1 11/2011 Claveroulas et al.
2012/0151981 A1* 6/2012 Yoshii ..... B21B 37/76 72/201

(Continued)

FOREIGN PATENT DOCUMENTS

CN 1166806 C 9/2004
CN 102272338 A 12/2011

(Continued)

OTHER PUBLICATIONS

Japanese Office Action, dated Nov. 14, 2017, for corresponding Japanese Application No. 2016-535808, along with a partial English translation.

(Continued)

*Primary Examiner* — Scott R Kastler
(74) *Attorney, Agent, or Firm* — Birch, Stewart, Kolasch & Birch, LLP

(57) ABSTRACT

A method for cooling a steel strip, comprising jetting mist to a steel strip passing through a cooling installation such that an amount of mist jetted to the steel strip is smaller in an edge portion in a width direction of the steel strip than in a center portion, sucking at least part of mist jetted to the steel strip, and cooling the steel strip at a sheet-passing speed such that, during a period between start and end of cooling, a temperature of the steel strip is within a film boiling tem-
(Continued)

perature range and a temperature of the edge portion in the width direction of the steel strip is equal to or higher than a temperature of the center portion in at least a range of ⅔ or more from the upstream side in the sheet-passing direction of a total cooling length of the cooling installation.

9 Claims, 8 Drawing Sheets

(51) Int. Cl.

| | |
|---|---|
| ***C23C 2/06*** | (2006.01) |
| ***C23C 2/28*** | (2006.01) |
| ***C23C 2/40*** | (2006.01) |
| ***C21D 1/667*** | (2006.01) |
| ***C21D 11/00*** | (2006.01) |

(52) U.S. Cl.
CPC ..... *C21D 11/005* (2013.01); *C23C 2/06* (2013.01); *C23C 2/28* (2013.01); *C23C 2/40* (2013.01)

(56) References Cited

U.S. PATENT DOCUMENTS

| | | | | |
|---|---|---|---|---|
| 2015/0259776 | A1* | 9/2015 | Shimizu | C23C 22/68 427/398.3 |
| 2017/0211165 | A1* | 7/2017 | Nishizawa | C23C 2/06 |

FOREIGN PATENT DOCUMENTS

| | | | |
|---|---|---|---|
| EP | 0921208 | A2 | 6/1999 |
| JP | 4-118447 | U | 10/1992 |
| JP | 5-279831 | A | 10/1993 |
| JP | 7-65153 | B2 | 7/1995 |
| JP | 9-268358 | A | 10/1997 |
| JP | 11-43758 | A | 2/1999 |
| JP | 2000-96202 | A | 4/2000 |
| JP | 2000-256818 | A | 9/2000 |
| JP | 2000-297357 | A | 10/2000 |
| JP | 2006-111945 | A | 4/2006 |
| JP | 2013-245376 | A | 12/2013 |

OTHER PUBLICATIONS

Canadian Office Action, dated Dec. 27, 2017, for corresponding Canadian Application No. 2,951,791.
International Search Report for PCT/JP2015/055012 dated May 26, 2015.
Written Opinion of the International Searching Authority for PCT/JP2015/055012 dated May 26, 2015.
Korean Office Action for corresponding Korean Application No. 10-2017-7001730, dated Feb. 1, 2018, with a partial English translation.
Extended European Search Report for European Application No. 15824065.5, dated Jan. 30, 2018.
Chinese Office Action and Search Report for corresponding Chinese Application No. 201580039117.3, dated Jul. 5, 2018, with a partial English translation of the Office Action.
Indonesian Office Action dated Mar. 22, 2019, for corresponding Indonesian Patent Application No. P00201701038, with English translation.
Indonesian Office Action dated May 3, 2019, for corresponding Indonesian Patent Application No. P00201701038, with English translation.
European Office Action, dated Mar. 11, 2019, for corresponding European Application No. 15824065.5.

* cited by examiner

METHOD FOR COOLING STEEL STRIP AND COOLING APPARATUS

TECHNICAL FIELD

The present invention relates to a method for cooling a steel strip and a cooling apparatus in a galvannealing furnace for hot-dip galvannealing.

BACKGROUND ART

In a hot-dip galvannealing treatment step for a steel strip, the steel strip passes through a pre-treatment bath for degreasing, cleaning, or the like and then passes through an annealing furnace and a zinc pot containing molten zinc, then being raised perpendicularly. The raised steel strip is subjected to galvannealing treatment in a galvannealing furnace. The galvannealing furnace includes a heating zone and a cooling zone arranged from the upstream side in a direction in which the steel strip is raised.

That is, the cooling zone of the galvannealing furnace is arranged vertically above the heating zone. Therefore, cooling of the steel strip in the cooling zone is performed using gas cooling or mist cooling so as not to exert an influence, such as dripping water, on an installation arranged vertically below the cooling zone. In particular, it is effective to use mist cooling (mist cooling) which has high cooling capacity in order to improve production capacity. In mist cooling, however, in the case where a large amount of water is sprayed in order to strongly cool the steel strip, temperature unevenness occurs in the width direction of the steel strip. This temperature unevenness causes quality defects, such as wrinkles and zinc powder pick-up.

In view of such a problem, for example, Patent Literature 1 discloses a galvannealing furnace exit-side mist cooling method in which a cooling pattern of a steel strip is adjusted so that temperature deviation in the width direction due to overcooling is suppressed. In Patent Literature 1, in order to suppress cooling variation due to dripping water and make temperature unevenness equal to or less than wrinkle limit temperature unevenness, a steel strip is cooled in a manner that a cooling ratio between a preceding stage and a subsequent stage of a cooling zone is changed so that the subsequent stage is subjected to slow cooling.

Patent Literature 2 discloses a cooling method in a galvannealing treatment process. The method uses either of gas cooling and mist cooling according to cooling load to avoid transition boiling and suppress temperature deviation in the width direction.

Furthermore, Patent Literature 3 discloses a technology of arranging nozzles densely in a center portion in the width direction of a steel strip and providing shutters for blocking the nozzles.

Patent Literature 4 discloses a technology of controlling a tension value and temperature unevenness based on a predetermined relational expression to set a cooling zone exit-side temperature to 240° C. or lower in order to prevent reduction of area and buckling of a steel sheet at the exit side of a mist cooling installation.

Patent Literature 5 discloses a technology of using either of mist cooling and cooling with gas for each zone to avoid a transition boiling region, which causes cooling variation, in order to make an Fe concentration amount in a plating layer appropriate.

CITATION LIST

Patent Literature

Patent Literature 1: JP 2006-111945A
Patent Literature 2: JP H11-43758A
Patent Literature 3: JP H7-65153B
Patent Literature 4: JP H9-268358A
Patent Literature 5: JP 2000-256818A

SUMMARY OF INVENTION

Technical Problem

However, the cooling method described in Patent Literature 1 is a method for resolving temperature unevenness using a cooling pattern in which the preceding stage is subjected to high-load cooling and the subsequent stage is subjected to slow cooling, and therefore faces a limit in achieving both ensuring cooling capacity of the cooling zone and resolving temperature unevenness. The cooling method described in Patent Literature 2 uses either of gas cooling and mist cooling, and also in this case, it is obvious that gas cooling lowers cooling capacity of the cooling zone. That is, both of the methods described in Patent Literatures 1 and 2 have a limited effect in resolving temperature unevenness under high-speed sheet passing conditions. Consequently, sheet passing cannot be performed at high speed, which results in low productivity.

Moreover, when the technology disclosed in Patent Literature 3 is used, the shutters obstruct the flow of mist and cause dripping water; therefore, this technology cannot be applied. In addition, the nozzles arranged densely in the center portion increases water amount density in the center portion near the quench point, leading to an increase in quench point temperature to cause cooling unevenness in the width direction.

The technology disclosed in Patent Literature 4 is a technology of setting allowable temperature unevenness based on the tension value of the steel sheet. Since the tension value of the steel sheet cannot be changed to an extreme, this technology cannot be applied in actual operation.

In addition, with the technology disclosed in Patent Literature 5, it is difficult to completely suppress occurrence of cooling unevenness due to the influence of dripping water.

Hence, the present invention has been made in view of the above problem, and aims to provide a novel and improved method for cooling a steel strip and a novel and improved cooling apparatus that perform mist cooling on a steel strip in a cooling zone of a galvannealing furnace and can achieve both productivity and quality.

Solution to Problem

According to an aspect of the present invention in order to achieve the above-mentioned object, there is provided a method for cooling a steel strip by mist cooling in a cooling installation of a galvannealing furnace configured to perform galvannealing treatment on a hot-dip galvanized steel strip. The cooling method includes: by an adjusted cooling installation provided at an upstream side in a sheet-passing direction of the cooling installation, jetting mist to the steel strip passing through the cooling installation in a manner that an amount of mist jetted to the steel strip passing through the cooling installation is smaller in an edge portion in a width direction of the steel strip than in a center portion;

by a mist suction installation provided at least at a downstream side in the sheet-passing direction of the cooling installation, sucking at least part of mist jetted to the steel strip; and cooling the steel strip at a sheet-passing speed such that, during a period between start and end of cooling of the steel strip, a temperature of the steel strip is within a film boiling temperature range and a temperature of the edge portion in the width direction of the steel strip is equal to or higher than a temperature of the center portion in at least a range of ⅔ or more from the upstream side in the sheet-passing direction of a total cooling length of the cooling installation.

With respect to an installation length L [m] of the adjusted cooling installation, a speed of the steel strip may be set to be equal to or less than an upper limit speed $V_{max}$[m/s] calculated using a formula (a) below, $$V_{max}=(L\times(T_{in}-\beta')\hat{}m\times(T_{in}-\gamma'))/(\alpha'\times th) \quad \text{(a)},$$

where $T_{in}$ [° C.] denotes a temperature of the center portion of the steel strip at an entrance of the cooling installation, th [m] denotes a thickness of the steel strip, and α', β', γ', and m are constants set according to a hot-dip galvannealing installation. The constants may be set as follows: α'=1870000, β'=330, γ'=45, m=0.6.

According to another aspect of the present invention in order to achieve the above-mentioned object, there is provided a cooling installation by mist cooling of a galvannealing furnace configured to perform galvannealing treatment on a hot-dip galvanized steel strip. The cooling apparatus includes: an adjusted cooling installation provided at an upstream side in a sheet-passing direction of the cooling installation, the adjusted cooling installation being capable of adjusting, in a width direction of the steel strip, an amount of mist jetted to the steel strip passing through the cooling installation; and a mist suction installation provided at least at a downstream side in the sheet-passing direction of the cooling installation, the mist suction installation being configured to suck at least part of mist jetted to the steel strip. The adjusted cooling installation is adjusted in a manner that an amount of mist jetted to the steel strip passing through the cooling installation is smaller in an edge portion in the width direction of the steel strip than in a center portion, and the cooling installation has an installation length in the sheet-passing direction of the steel strip such that, during a period between start and end of cooling of the steel strip, a temperature of the steel strip is within a film boiling temperature range and a temperature of the edge portion in the width direction of the steel strip is equal to or higher than a temperature of the center portion in at least a range of ⅔ or more from the upstream side in the sheet-passing direction of a total cooling length of the cooling installation.

The adjusted cooling installation may be provided in a manner that an installation length L [m] of the adjusted cooling installation in the sheet-passing direction of the steel strip satisfies a formula (b) below, $$L\geq(\alpha\times V\times th)/((T_{in}-\beta)\hat{}m)\times(T_{in}-\gamma)) \quad \text{(b)}$$

where $T_{in}$[° C.] denotes a temperature of the center portion of the steel strip at an entrance of the cooling installation, V [m/s] denotes a speed of the steel strip, th [m] denotes a thickness of the steel strip, and α, β, γ, and m are constants set according to a hot-dip galvannealing installation. The constants may be set as follows: α=1700000, β=330, γ=45, m=0.6.

The adjustment cooling installation may include, in the sheet-passing direction, a plurality of headers each including a plurality of nozzles arranged along the width direction. Each header may be configured in a manner that mist is not jetted to the steel strip in the edge portion in the width direction of the steel strip.

Each header of the adjusted cooling installation may be configured in a manner that the number of the nozzles that jet mist to the steel strip in the center portion in the width direction of the steel strip increases from the upstream side toward the downstream side in the sheet-passing direction.

Advantageous Effects of Invention

According to the present invention, it is possible to provide a method for cooling a steel strip and a cooling apparatus that perform mist cooling on a steel strip in a cooling zone of a galvannealing furnace and can achieve both productivity and quality.

DESCRIPTION OF EMBODIMENTS

Figure 1:
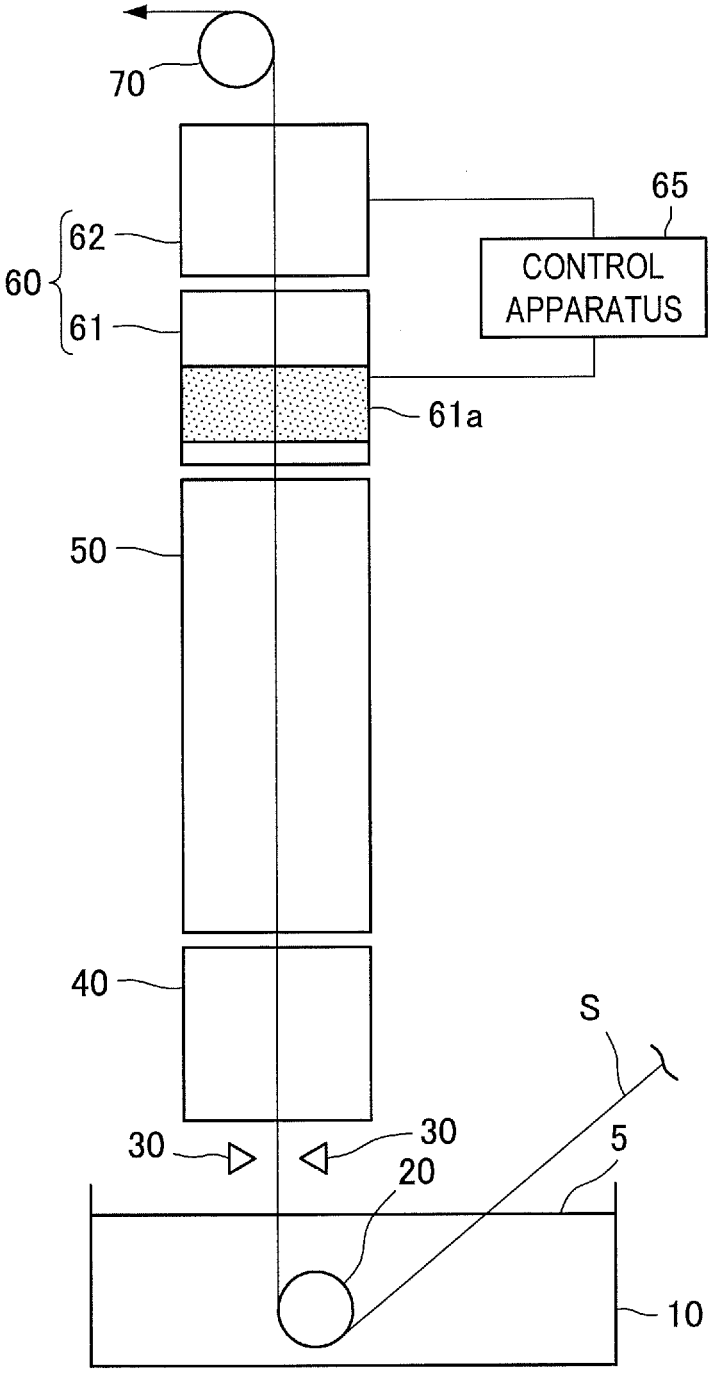
FIG. 1 is a schematic explanatory diagram illustrating a schematic configuration of a hot-dip galvannealing installation provided with a cooling installation according to an embodiment of the present invention.

Hereinafter, (a) preferred embodiment(s) of the present invention will be described in detail with reference to the appended drawings. In this specification and the appended drawings, structural elements that have substantially the same function and structure are denoted with the same reference numerals, and repeated explanation of these structural elements is omitted.

<1. Overview of Hot-Dip Galvannealing Installation>

First, with reference to FIG. 1, description will be given on a schematic configuration of a hot-dip galvannealing installation provided with a cooling installation according to an embodiment of the present invention. FIG. 1 is a schematic explanatory diagram illustrating a schematic configuration of a hot-dip galvannealing installation provided with a cooling installation according to the present embodiment.

Examples of steel grades to be treated by the hot-dip galvannealing installation according to the present embodiment include ultra-low carbon steel and high tensile strength steel sheets. In general, steel materials with thicknesses of 0.4 to 3.2 mm and widths of 600 to 1900 mm are treated.

As illustrated in FIG. 1, the hot-dip galvannealing installation includes a zinc pot 10 containing molten zinc 5 for plating the surface of a steel strip S, a pair of gas nozzles 30 for adjusting the amount of plating attached to the steel strip S, and a galvannealing furnace including a heating zone 40, a heat-retaining zone 50, and a cooling zone 60. Although the hot-dip galvannealing installation according to the present embodiment includes the heat-retaining zone 50, the present invention is not limited to such an example, and is also applicable to a hot-dip galvannealing installation without the heat-retaining zone 50. In the hot-dip galvannealing installation, the steel strip S is brought into the zinc pot 10 containing the molten zinc 5, and is raised perpendicularly by a sink roll 20 immersed in the molten zinc 5. The amount of plating attached to the surface of the raised steel strip S is adjusted to a predetermined amount by wiping gas jetted from the gas nozzles 30.

After that, the steel strip S is subjected to galvannealing treatment in the galvannealing furnace while being further raised perpendicularly. In the galvannealing furnace, first, the steel strip S is heated by the heating zone 40 to have a substantially uniform sheet temperature, and then galvannealing time is provided in the heat-retaining zone 50; thus, an alloy layer is generated. After that, the steel strip S is cooled in the cooling zone 60, and transported to the next step by a top roll 70.

The cooling zone 60 of the galvannealing furnace according to the present embodiment includes a cooling-zone preceding stage section 61 provided at the upstream side in the sheet-passing direction of the steel strip S (i.e., the vertically lower side (the zinc pot 10 side)), and a cooling-zone subsequent stage section 62 provided at the downstream side in the sheet-passing direction of the steel strip S (i.e., the vertically upper side) with respect to the cooling-zone preceding stage section 61. The cooling-zone preceding stage section 61 and the cooling-zone subsequent stage section 62 each include mist headers (reference sign "63" in FIGS. 8 and 9) arranged in multiple stages. Each mist header is provided with a plurality of mist jet nozzles (reference sign "64" in FIG. 9) that jet cooling water in a mist form. Mist jetted from the mist jet nozzles is sprayed onto the surface of the steel strip S. The amount of cooling water supplied to each mist header is controlled by a control apparatus 65.

In addition, the cooling zone 60 is provided with at least one pair of mist suction installations (reference sign "67" in FIG. 6) arranged to face the edge portions in the width direction of the steel strip S. The mist suction installations are provided at least at the downstream side in the sheet-passing direction of the cooling zone 60, and suck at least part of the mist jetted to the steel strip S.

<2. Mechanism of Mist Cooling>

Figure 2:
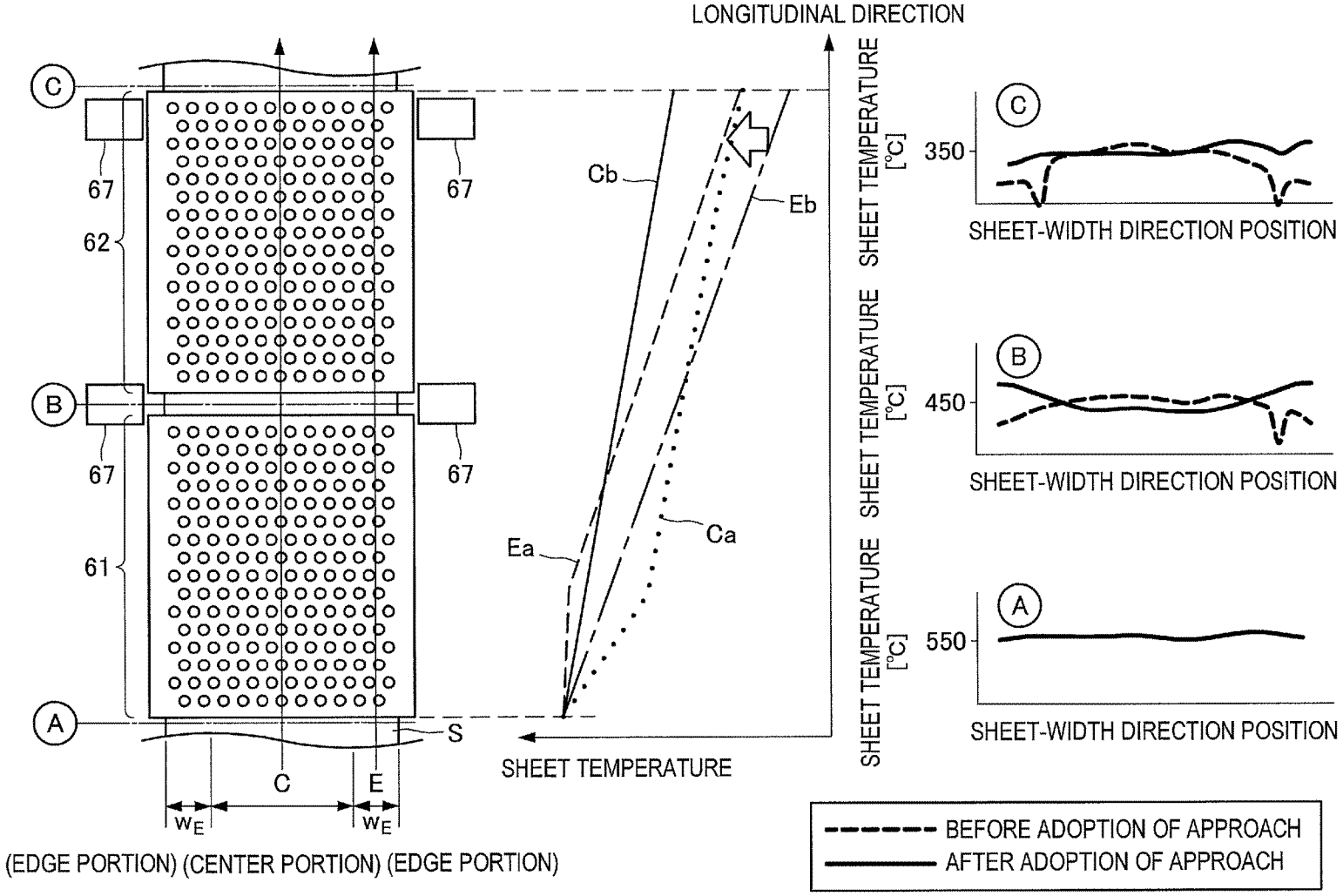
FIG. 2 is an explanatory diagram showing sheet temperature distribution in the width direction and the longitudinal direction of a steel strip passing through a cooling zone.

Conventionally, mist cooling which has high cooling capacity has been used in order to improve production capacity; however, mist cooling, when spraying a large amount of water to strongly cool the steel strip S, causes temperature unevenness in the width direction of the steel strip S, leading to quality defects. FIG. 2 shows sheet temperature distribution in the width direction and the longitudinal direction of the steel strip S passing through the cooling zone 60. The temperature distribution in the longitudinal direction in FIG. 2 shows a temperature Cb of a center portion and a temperature Eb of an edge portion before adoption of the present application approach and a temperature Ca of a center portion and a temperature Ea of an edge portion after adoption of the present application approach. The temperature distribution in the width direction in FIG. 2 shows temperature distribution before adoption of the present application approach and temperature distribution after adoption of the present application approach at positions A, B, and C in the longitudinal direction. The position A is a position at which cooling of the steel strip S by the cooling zone 60 starts, the position B is a position between the cooling-zone preceding stage section 61 and the cooling-zone subsequent stage section 62, and the position C is a position at which cooling of the steel strip S by the cooling zone 60 ends.

Here, a portion at the center in the width direction of the steel strip S is called a center portion, and both end sides in the width direction are called edge portions. The edge portion refers to a range from the end in the width direction of the steel strip S to a boundary position 100 mm away from the end.

Before adoption of the present application approach, as shown in FIG. 2, regarding the temperature of the steel strip S in the longitudinal direction, the temperature Eb of the edge portion is lower than the temperature Cb of the center portion. With movement from the cooling-zone preceding stage section 61 to the cooling-zone subsequent stage section 62, the temperature of the steel strip S gradually decreases in both the center portion and the edge portion, and the difference between these temperatures gradually increases. That is, according to the temperature distribution in the width direction, with the transportation of the steel strip S, the temperature of the edge portion becomes low in comparison with the temperature of the center portion, and at the position C, which is the cooling zone 60 exit side, the temperature distribution is convex upward.

A cause of the temperature distribution in the width direction is gas flow toward a sheet end direction inside the cooling zone. When gas from nozzles that are arranged near the center in the sheet width direction goes toward exhaust ports, gas flow via the ends in the width direction of the cooling zone 60 occurs, and the gas flow causes mist attached on the surface of the steel strip S to flow toward both ends of the steel strip S, which reduces the sheet temperature of the edge portions of the steel strip S. For a portion with high temperature in the steel strip S, the top roll 70 picks up zinc powder on the surface of the steel strip, which causes quality defects. On the other hand, for a portion with low temperature in the steel strip S, the temperature falls below a quench temperature, which is the boundary temperature between a film boiling region and a transition boiling region of water, and this leads to local overcooling, causing wrinkles. Therefore, temperature distribution in the width direction of the steel strip S needs to be made uniform finally.

Also in the present embodiment, mist cooling is used as cooling means in the cooling zone 60 in order to improve production capacity. To prevent occurrence of quality defects as well as improving production capacity by using mist cooling, the present application inventors have devised, as a result of extensive studies, a configuration of a cooling installation that suppresses overcooling of the edge portion of the steel strip S, makes width-direction temperature distribution of the steel strip S finally uniform, and avoids unstable cooling.

That is, in the cooling zone 60 of the galvannealing furnace according to the present embodiment, in order to stably cool the steel strip S, a sheet temperature at which mist attached to the steel strip S undergoes film boiling is maintained in the cooling zone 60. Liquid in a boiled state changes its form from nuclear boiling to transition boiling and then film boiling as its temperature increases. The temperature of the steel strip S is ordinarily in a temperature region in which water undergoes film boiling at the entry side of the cooling zone 60 of the galvannealing furnace. After that, with a decrease in the temperature of the steel strip S, a region where water shifts from film boiling to transition boiling partially occurs on the surface of the steel strip S, which leads to unstable cooling, causing temperature unevenness in the steel strip S. Hence, in the present embodiment, cooling is performed in a manner that a sheet temperature at which mist attached to the steel strip S undergoes film boiling is maintained in the cooling zone 60.

Furthermore, in order to suppress overcooling of the edge portion of the steel strip S, at the upstream side in the sheet-passing direction, the amount of mist jetted to the steel strip S is adjusted so that a mist jet amount in the edge portion in the width direction of the steel strip S is smaller than that in the center portion. If the steel strip S is cooled with the same mist jet amount throughout the width direction of the steel strip S, the temperature of the edge portion of the steel strip S decreases greatly as described above, leading to large temperature deviation from the center portion.

Hence, at the upstream side in the sheet-passing direction, mist jetted to the steel strip S is adjusted to suppress cooling of the edge portion of the steel strip S, and excessive mist in the edge portion of the steel strip S is eliminated; thus, the sheet temperature of the edge portion of the steel strip S is prevented from decreasing during sheet passing. In this manner, overcooling of the edge portion is prevented, and as shown in FIG. 2, during a period between the start and the end of cooling by the cooling zone 60, the temperature of the steel strip S is in a film boiling temperature range and the temperature of the edge portion of the steel strip S is equal to or higher than the temperature of the center portion.

According to the temperature distribution in the width direction of the steel strip S, as in the state at the position B, for example, a temperature curve is obtained in which the temperature of the edge portion is high with respect to that of the center portion in the width direction of the steel strip S. Then, with the transportation of the steel strip S, as shown in the distribution in the longitudinal direction of the steel strip S in FIG. 2, temperature deviation between the temperature Ea of the edge portion and the temperature Ca of the center portion becomes smaller, so that the temperature distribution in the width direction of the steel strip S can be substantially uniform finally at the exit side of the cooling zone 60. That is, setting the temperature of the steel strip S such that, during a period between the start and the end of cooling by the cooling zone 60, the temperature of the steel strip S is in a film boiling temperature range and the temperature of the edge portion of the steel strip S is equal to or higher than the temperature of the center portion avoids an unstable transition boiling state of the edge portion of the steel strip S, preventing quality defects of the steel strip S.

Note that the temperature of the edge portion of the steel strip S does not necessarily need to be equal to or higher than the temperature of the center portion throughout the range between the start and the end of cooling by the cooling zone 60, as long as the temperature of the edge portion of the steel strip S is equal to or higher than the temperature of the center portion in at least a range of ⅔ or more from the upstream side in the sheet-passing direction of the total cooling length in the sheet-passing direction of the cooling zone 60. If the temperature of the edge portion of the steel strip S is equal to or higher than the temperature of the center portion in this range, the quality of the steel strip S can be kept within an allowable range.

Although ideal final temperature difference is zero as shown in FIG. 2, in actuality, there is a margin between the upper limit temperature at which wrinkles occur and the lower limit temperature at which zinc powder pick-up occurs, and the temperature margin is generally approximately 40° C. Accordingly, as long as the temperature of the edge portion of the steel strip S is equal to or higher than the temperature of the center portion in a range of ⅔ or more of the total cooling length from the upstream side in the sheet-passing direction, final temperature deviation can be kept within a temperature range in which wrinkles and zinc powder pick-up can be avoided. This finding has been obtained by consideration based on results of investigation of the amount, of generated temperature deviation of the steel strip S in a practical line.

Here, at a cooling intermediate position of the total cooling length, it is desirable that the temperature of the edge portion of the steel strip S be higher than the temperature of the center portion by 20° C. or more. That is, when, at the cooling intermediate position of the total cooling length, a temperature curve is obtained in which the temperature of the edge portion is high with respect to that of the center portion in the width direction of the steel strip S, as shown at the position B in FIG. 2, the temperature distribution in the width direction of the steel strip S can be substantially uniform finally at the exit side of the cooling zone 60.

<3. Steel Strip Cooling by Cooling Installation of Cooling Zone>

(3-1. Method for Cooling Steel Strip)

Figure 3:
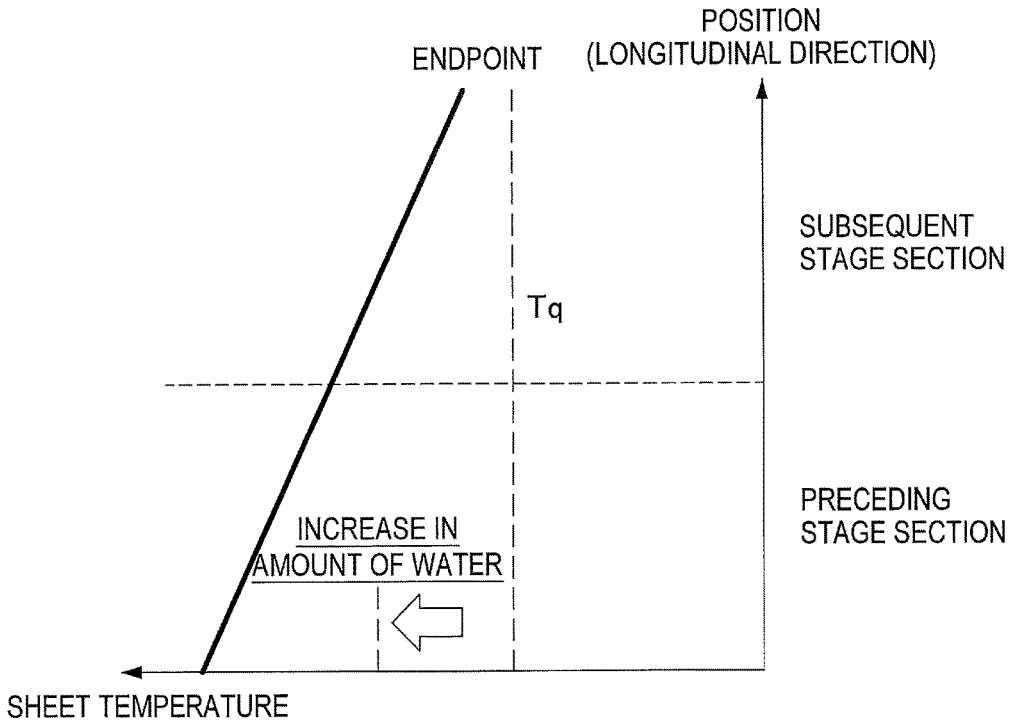
FIG. 3 is an explanatory diagram showing an outline of sheet temperature control by a cooling zone of a galvannealing furnace according to the embodiment.

FIG. 3 shows an outline of sheet temperature control by the cooling zone 60 of the galvannealing furnace according to the present embodiment. As shown in FIG. 3, the steel strip S is cooled to a target endpoint temperature by passing through the cooling zone 60. In general, in hot-dip galvannealing treatment, the temperature of the steel strip S at the entry side of the cooling zone 60 of the galvannealing furnace is approximately 450 to 600° C., and the endpoint temperature is approximately 300 to 400° C. A quench temperature Tq shown in FIG. 3 is the boundary temperature between a film boiling region and a transition boiling region of water. A temperature range higher than the quench temperature Tq is a film boiling temperature range in which water undergoes film boiling on the surface of the steel strip S. The quench temperature Tq changes depending on cooling conditions, and tends to increase when the steel strip S is strongly cooled with a large amount of water.

As shown in FIG. 3, a temperature difference between the endpoint temperature and the quench temperature Tq is smaller than a temperature difference between the sheet temperature at the entry side of the cooling zone 60 and the quench temperature Tq. Accordingly, when the steel strip S is strongly cooled in the cooling-zone subsequent stage section 62, the quench temperature Tq increases, making the temperature difference between the endpoint temperature and the quench temperature Tq even smaller. This increases the possibility of mist undergoing transition boiling in the cooling-zone subsequent stage section 62, and may cause temperature unevenness in the steel strip S. The cooling zone 60 according to the present embodiment always prevents the sheet temperature from becoming equal to or lower than the quench temperature Tq, while actively cooling the steel strip S with a large amount of water at the upstream side in the sheet-passing direction of the cooling zone 60.

Specifically, at the upstream side in the sheet-passing direction of the cooling-zone preceding stage section 61, there is provided an adjusted cooling installation 61*a* in which the amount of mist jetted to the steel strip S passing through the cooling zone 60 is adjusted in the width direction of the steel strip S. The adjusted cooling installation 61*a* is a cooling installation adjusted to actively cool the center portion in the width direction of the steel strip S and suppress cooling of the edge portion. The adjusted cooling installation 61*a* is installed to prevent great temperature distribution in the width direction of the steel strip S, while preventing the temperature of the steel strip S from becoming equal to or lower than the quench temperature at which water shifts from film boiling to transition boiling.

The adjusted cooling installation 61*a* is provided at the upstream side in the sheet-passing direction of the cooling-zone preceding stage section 61 because, as described above, there is a larger margin of a control width of the temperature of the steel strip S than at the downstream side in the sheet-passing direction of the cooling zone 60. Since the target endpoint temperature of the steel strip S is near the quench temperature of water, the control apparatus 65 needs to have high control precision in order to prevent the temperature of the steel strip S from becoming equal to or lower than the quench temperature. Hence, it is desirable that the adjusted cooling installation 61*a* be provided at the upstream side in the sheet-passing direction of the cooling-zone preceding stage section 61 and actively cool the steel strip S with a large amount of water.

Moreover, the cooling zone 60 according to the present embodiment is provided with the mist suction installations 67 that suck at least part of the mist jetted to the steel strip S together with air present in the cooling zone 60 in order to minimize the influence of a position change of a quench point. Thus, excessive mist that causes dripping water is sucked, which prevents excessive mist from being poured on the steel strip S as dripping water.

These mist suction installations 67 are preferably provided at least near portions facing the edge portions of the steel strip S in the cooling zone 60. Providing the mist suction installations 67 at such positions makes it possible to more effectively suck excessive mist that may cause dripping water in the edge portions.

In addition, these mist suction installations 67 are preferably provided at least at the downstream side in the sheet-passing direction of the cooling zone 60. At the downstream side in the sheet-passing direction, where the steel strip S has lower temperature, there is a high possibility that dripping water causes a change in the position of the quench point, and the boiling state shifts from a film boiling state to a transition boiling state. Accordingly, providing the mist suction installations 67 mainly at the downstream side in the sheet-passing direction of the cooling zone 60 makes it possible to suppress temperature variation due to dripping water more effectively. Note that the number of the mist suction installations 67 provided in the cooling zone 60 is not limited, and may be set as appropriate depending on the size of the cooling zone 60, the amount of mist to be sucked from the cooling zone 60, and the like.

The amount of excessive mist sucked by the mist suction installations 67 is controlled by the control apparatus 65. Making the control apparatus 65 control both the adjusted cooling installation 61*a* and the mist suction installations 67 enables more efficient management of the cooling state of the steel strip S.

Here, if the amount of mist sucked by the mist suction installations 67 is too small, dripping water due to residual excessive mist occurs. If the amount of sucked mist is too large, the steel strip S is not cooled sufficiently. Hence, the amount of mist sucked by the mist suction installations 67 under control of the control apparatus 65 is preferably set within a predetermined range in which the steel strip S can be cooled sufficiently while occurrence of dripping water is prevented.

The amount of exhaust air and mist sucked by the mist suction installations 67 can be controlled by a known method, and for example, can be controlled according to the value of a pressure gauge (reference sign "69" in FIG. 6) provided near a mist suction port for the mist suction installations 67. That is, a pressure value in the center portion of the steel strip S near the mist suction port may be measured using the pressure gauge provided near the mist suction port, and damper opening of exhaust blowers provided in the mist suction installations 67 may be adjusted to make the measured pressure value negative.

To adjust width-direction temperature distribution with a limited installation length of the adjusted cooling installation 61*a* in the sheet-passing direction, the adjusted cooling installation 61*a* needs to be used with a large amount of water. On the other hand, to use the adjusted cooling installation 61*a* in a film boiling region, it is desirable that the adjusted cooling installation 61*a* be used with a small amount of water in order to avoid an increase in the quench temperature Tq. Thus, only with the installation of the adjusted cooling installation 61*a*, conditions for adjusting width-direction temperature distribution and conditions for stable cooling in a film boiling region are mutually contradictory and not easily compatible. Making the installation length of the adjusted cooling installation 61*a* unnecessarily long brings about problems in that the installation becomes complex and requires high installation cost, and the temperature of the edge portion rather becomes high in a target material for which width-direction temperature distribution does not need to be adjusted.

Hence, the present application inventors studied an installation for achieving suppression of width-direction temperature distribution and maintenance of film boiling conditions, and as a result, found that the installation length L [m] of the adjusted cooling installation 61*a* is required to satisfy the following formula (1).

$$L \geq (\alpha \times V \times th)/((T_{in}-\beta)\hat{}m) \times (T_{in}-\gamma)) \quad (1)$$

Here, $T_{in}$[° C.] denotes the temperature of the center portion of the steel strip S at the entrance of the cooling zone 60, V [m/s] denotes the speed of the steel strip S, and th [m] denotes the thickness of the steel strip. In addition, α, β, γ, and m are constants, which are set according to the hot-dip galvannealing installation.

The present application inventors, under various operation conditions, investigated the ability to adjust width-direction temperature distribution and the cooling stability with respect to the water amount of the adjusted cooling installation 61*a*. As a result, they found, among conditions under which a film boiling region can be maintained, the presence of a water amount that makes the width-direction temperature distribution smallest. It was also found that the water amount is related to the temperature of the steel strip S at the entrance of the cooling zone 60, the speed of the steel strip S, the thickness of the steel strip S, and the installation length L of the adjusted cooling installation 61*a*. Hence, using this relationship, they derived the above formula (1) to specify the installation length L of the adjusted cooling installation 61*a* necessary to obtain a width-direction temperature distribution adjustment effect.

Figure 4:
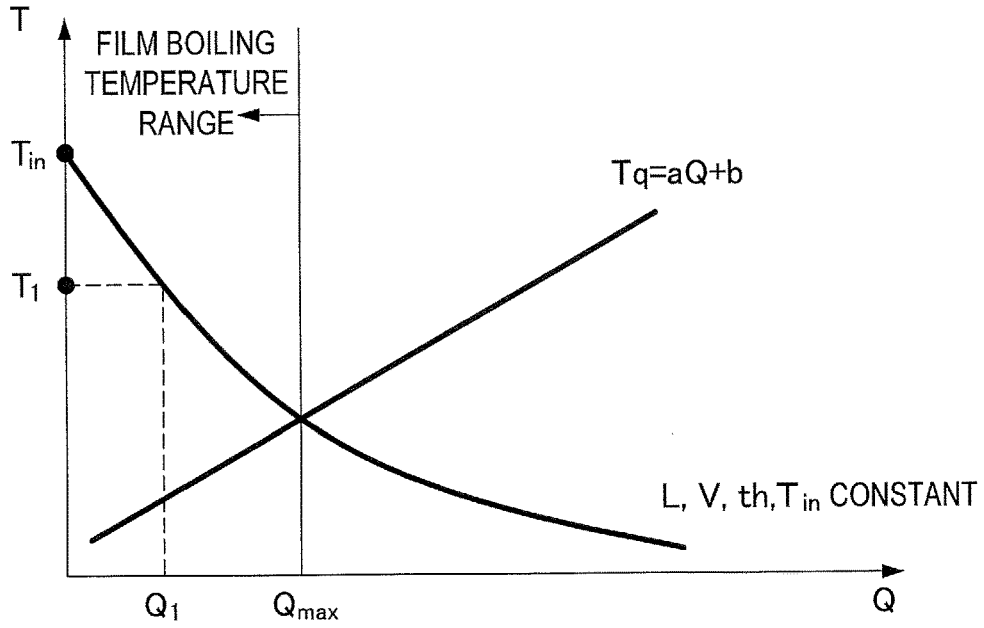
FIG. 4 is a graph showing the relationship between a cooling water amount and a quench temperature and the relationship between a cooling water amount and the temperature of a center portion of a steel strip.

The formula (1) is derived in the following manner. First, the quench temperature Tq tends to increase when the steel strip S is strongly cooled with a large amount of water, as described above. This relationship can be obtained by evaluating cooling characteristics of a steel strip by using a test installation imitating a real-world installation. For example, as shown in FIG. 4, the quench temperature Tq is expressed by a direct function of a cooling water amount Q as in the following formula (1-1). In the formula (1-1), a and b are constants.

$$Tq=aQ+b \tag{1-1}$$

As shown in FIG. 4, when the entry-side temperature $T_{in}$ of the steel strip S, the thickness th of the steel strip S, the speed V of the steel strip S, and the installation length L of the adjusted cooling installation 61*a* in a center portion (the center in the width direction) of the adjusted cooling installation 61*a* are constant, the cooling water amount Q and the temperature T of the center portion of the steel strip S have a relationship in which, as shown in FIG. 4, the temperature T of the center portion of the steel strip S decreases with an increase in the cooling water amount Q. Here, an improvement effect ΔT of a temperature difference between the center portion and the edge portion of the steel strip S by the adjusted cooling installation 61*a* is proportional to a difference between the entry-side temperature $T_{in}$ of the center portion of the steel strip S and a temperature $T_1$ at any position in the sheet-passing direction in the adjusted cooling installation 61*a*. That is, the improvement effect ΔT of temperature distribution in the width direction is expressed by the following formula (1-2). In the formula (1-2), α is a constant.

$$\Delta T=\alpha(T_{in}-T_1) \tag{1-2}$$

Figure 5:
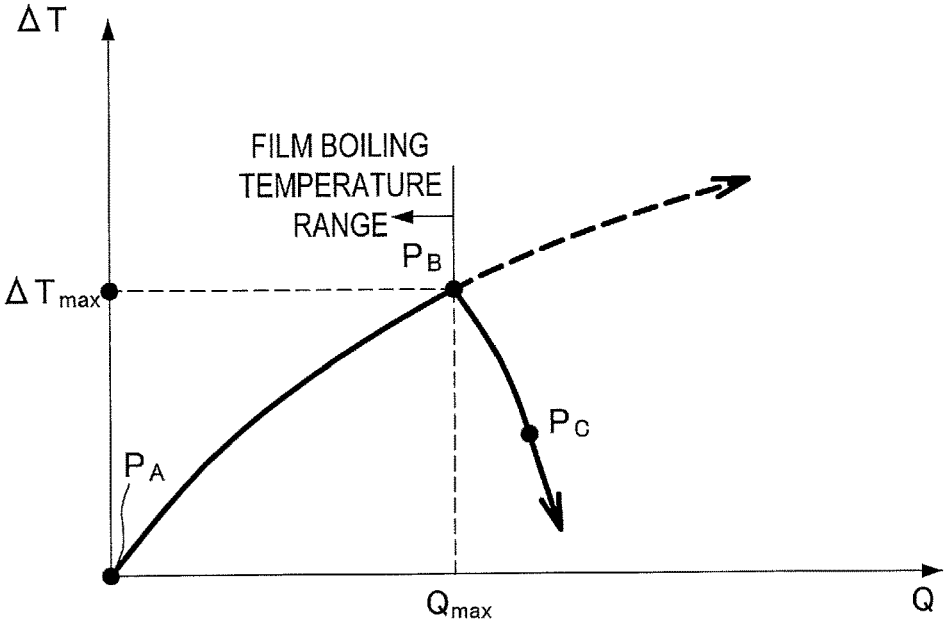
FIG. 5 is a graph showing the relationship between a cooling water amount and an improvement effect of temperature distribution in the width direction.

On the other hand, in order to prevent the steel strip S from being cooled to a temperature lower than the quench temperature Tq, temperature distribution in the width direction adjustable by the adjusted cooling installation 61*a* has an upper limit. That is, as shown in FIG. 5, between point $P_A$ and point $P_B$ indicating a position at which the temperature becomes the quench temperature Tq, the improvement effect ΔT of temperature distribution in the width direction increases as the cooling water amount Q increases. However, if the temperature T of the steel strip S falls below the quench temperature Tq, the steel strip S is subjected to local overcooling, and as shown in FIG. 5, the improvement effect ΔT of temperature distribution in the width direction sharply decreases from point $P_B$ toward point $P_C$.

Accordingly, temperature distribution in the width direction adjustable by the adjusted cooling installation 61*a* is within a film boiling temperature range (a range from point $P_A$ to point $P_B$) in which the temperature of the steel strip S is equal to or higher than the quench temperature Tq. Hence, $\Delta T_{max}$ denoting the improvement effect of temperature distribution in the width direction at the quench temperature Tq can be expressed by the following formula (1-3) according to the formula (1-2).

$$\Delta T_{max}=\alpha(T_{in}-Tq) \tag{1-3}$$

Furthermore, the installation length L of the adjusted cooling installation 61*a* is determined with respect to temperature distribution deviation that needs to be adjusted. Here, the upper limit $\Delta T_{max}$ of the improvement effect of temperature distribution adjustable as described above is expressed also by the temperature $T_{in}$ of the center portion at the entry side of the steel strip S, the thickness th and the speed V of the steel strip S, and the installation length L of the adjusted cooling installation 61*a*, as in the following formula (1-4).

$$\Delta T_{max}=(\alpha\cdot 2\cdot h\cdot L\cdot(T_{ave}-T_w))/(\rho\cdot Cp\cdot V\cdot th) \tag{1-4}$$

Here, $T_{ave}$ is the average sheet temperature, which is expressed by, for example, an average value of the temperature $T_{in}$ of the center portion at the entry side of the steel strip S and the quench temperature Tq. In addition, $T_w$ is cooling water temperature, ρ is a steel material density, and Cp is a steel material specific heat.

The above formula (1) can be obtained by organizing the relationship of the formula (1-4), the above formulae (1-1) and (1-3), and a formula (1-5) expressing the relationship between a cooling water amount Q [$l/m^2\cdot min$] and a heat transfer coefficient h [$W/m^{2\cdot}$° C.]. In the formula (1-5), k is a constant.

$$h=kQ^m \tag{1-5}$$

Here, the constants α, β, and γ of the above formula (1) are as follows.

$$\alpha=20280\times a^m/k \tag{1-7}$$

$$\beta=33+b \tag{1-8}$$

$$\gamma=45 \tag{1-9}$$

The constants α, β, and γ are set by using results of evaluation of cooling characteristics of a steel strip using a test installation imitating a real-world installation, and for example, can be set as follows: α=1700000, β=330, γ=45, m=0.6.

Note that the temperature T of the steel strip S at the entrance of the cooling zone 60, the speed V of the steel strip S, and the thickness th of the steel strip S are values determined by steel grades, the amount of production, and order sizes; therefore, the value of L calculated using the formula (1) is not a fixed value. Accordingly, the installation length L of the adjusted cooling installation 61*a* is determined assuming typical operation conditions, for example.

When the installation length L of the adjusted cooling installation 61*a* is constant, the steel strip S may be produced with a speed equal to or lower than the upper limit speed $V_{max}$ of the steel strip S calculated from the following formula (2), based on the relationship of the above formula (1). Here, α', β', γ', and m are constants, which are set according to the hot-dip galvannealing installation, and for example, can be set as follows: α'=1700000, β'=330, γ'=45, m=0.6. Since the speed V of the steel strip S changes depending on a sheet to be passed, these constants are set in consideration of a transient state.

$$V_{max}=(L\times(T_{in}-\beta')\hat{}m\times(T_{in}-\gamma'))/(\alpha'\times th) \tag{2}$$

In this manner, even when the installation length L of the adjusted cooling installation 61*a* cannot be changed, the upper limit speed $V_{max}$ of the steel strip S is changed according to steel grades, the amount of production, and order sizes, and the steel strip S is produced with a speed V equal to or lower than the upper limit speed $V_{max}$. This provides high productivity while avoiding quality defects due to cooling unevenness. The speed V of the steel strip S is reported to an operator by a guidance system, for example, to be changed.

Regarding temperature distribution in the width direction of the steel strip S, although no temperature distribution is desirable, temperature distribution within a predetermined temperature range does not greatly influence quality. For example, the predetermined temperature range is approximately 30° C. Regarding the endpoint temperature at the exit side of the cooling zone 60, the endpoint temperature is approximately 300 to 400° C. as described above. An endpoint temperature higher than this range may cause the top roll 70 to pick up zinc powder on the surface of the steel strip S. Accordingly, the maximum temperature among the temperatures in the width direction of the steel strip S at the exit side of the cooling zone 60 is controlled so as not to exceed 300 to 400° C.

[3-2. Configuration Example of Adjusted Cooling Installation]

Figure 6:
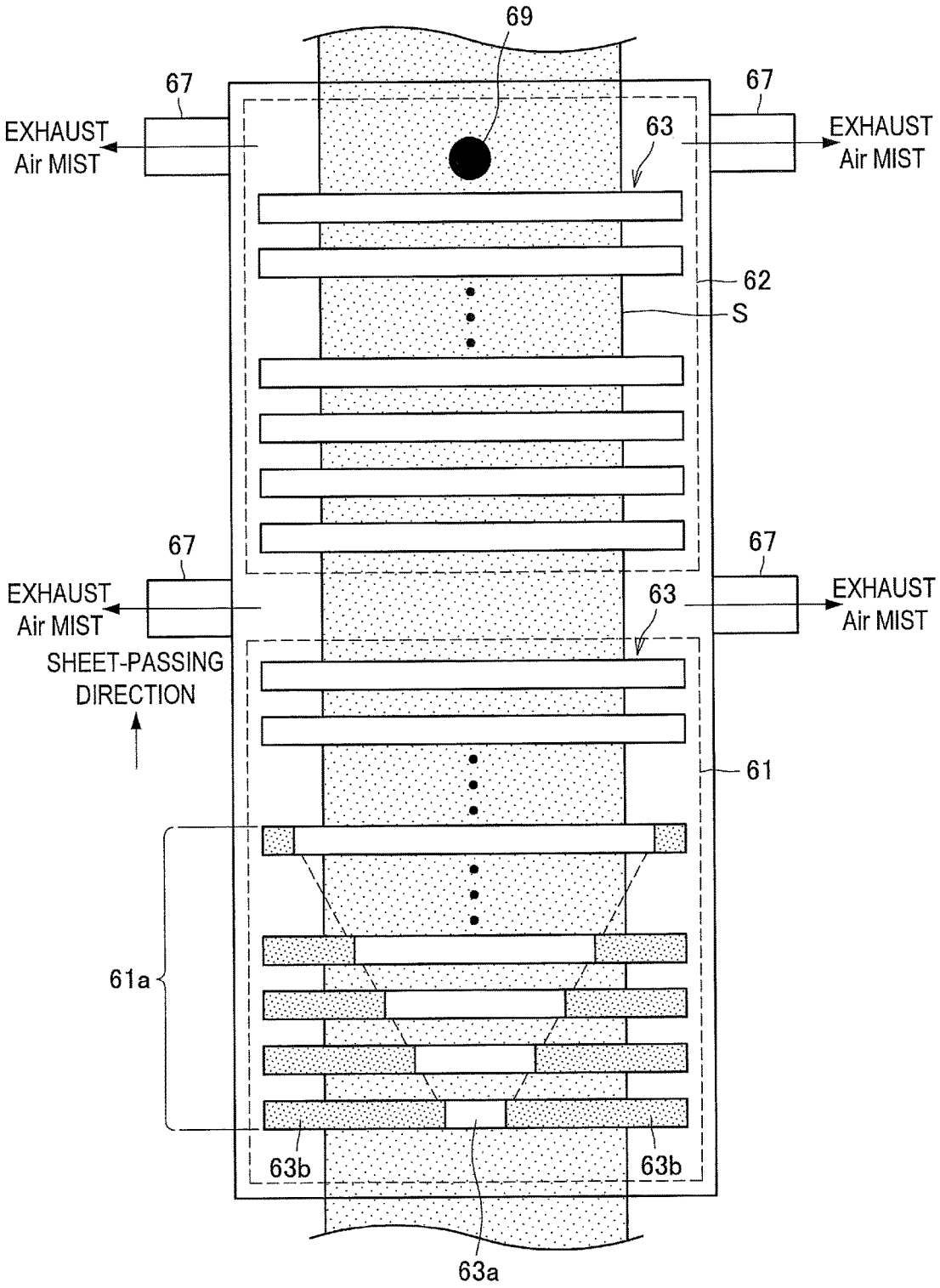
FIG. 6 is an explanatory diagram illustrating a configuration example of a cooling zone 60 according to the present embodiment.
Figure 7:
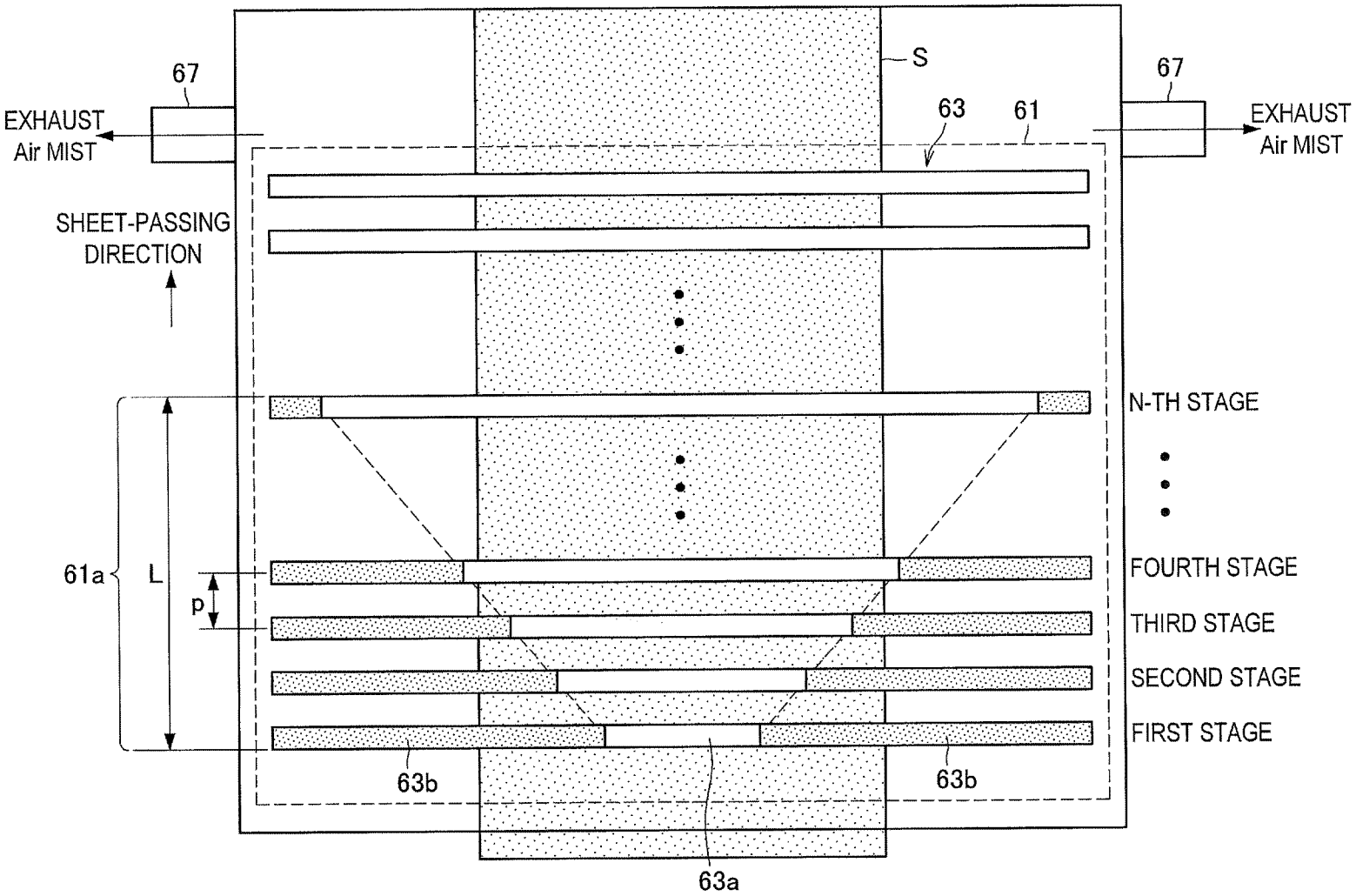
FIG. 7 is an explanatory diagram illustrating a configuration example of a cooling-zone preceding stage section including an adjusted cooling installation according to the embodiment.
Figure 8:
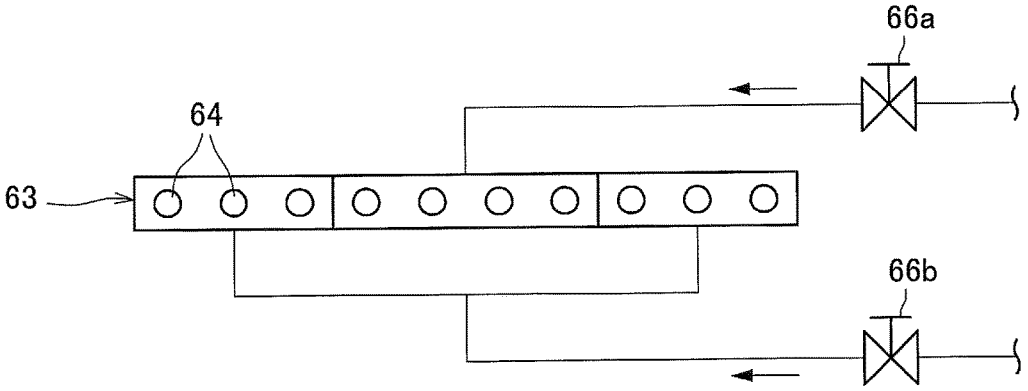
FIG. 8 is an explanatory diagram illustrating a configuration example of a mist header.
Figure 9:
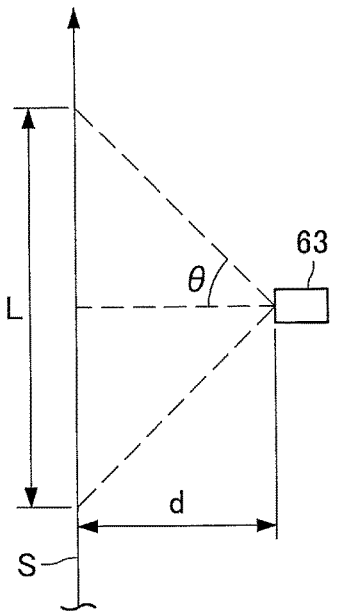
FIG. 9 is an explanatory diagram for explaining the installation length of an adjusted cooling installation when the adjusted cooling installation includes a single-stage mist header.

A configuration of the adjusted cooling installation 61*a* will be described based on FIGS. 6 to 9. FIG. 6 is an explanatory diagram illustrating a configuration example of the cooling zone 60 according to the present embodiment. FIG. 7 is an explanatory diagram illustrating a configuration example of the cooling-zone preceding stage section 61 including the adjusted cooling installation 61*a* according to the present embodiment. FIG. 8 is an explanatory diagram illustrating a configuration example of the mist header 63. FIG. 9 is an explanatory diagram for explaining the installation length of the adjusted cooling installation 61*a* when the adjusted cooling installation 61*a* includes a single-stage mist header 63.

The cooling zone 60 according to the present embodiment includes a plurality of mist headers 63 arranged in the longitudinal direction. In the mist header 63, a plurality of mist jet nozzles 64 are arranged along the width direction of the steel strip S, as illustrated in FIG. 8. The cooling-zone preceding stage section 61 and the cooling-zone subsequent stage section 62 are each provided with a plurality of stages (e.g., about 30 stages) of mist headers 63. The cooling zone 60 as illustrated in FIG. 7 is provided in a symmetrical arrangement about the sheet-passing direction of the steel strip S. Thus, the steel strip S is cooled from its front and rear surfaces. The amount of mist jetted from the mist jet nozzles 64 (i.e., the water amount of the mist header 63) can be adjusted by opening and closing valves 66*a* and 66*b* illustrated in FIG. 8. The opening and closing of the valves 66*a* and 66*b* can be controlled for each stage by the control apparatus 65.

The adjusted cooling installation 61*a* can be configured for example by blocking, with caps, the mist jet nozzles 64 at the edge portion sides in the width direction of the steel strip S, among the mist jet nozzles 64 arranged in each mist header 63, to prevent the mist jet nozzles 64 from jetting mist. In the example of FIG. 7, the edge portions of the mist headers 63 of first to n-th stages located at the upstream side in the sheet-passing direction of the cooling-zone preceding stage section 61 are blocked with caps to form a non jetting region 63*b*. Accordingly, while passing through the adjusted cooling installation 61*a*, the steel strip S is actively cooled in the center portion corresponding to a jetting region 63*a*, whereas cooling of the both edge portions is suppressed.

Note that the number n of the mist headers 63 included in the adjusted cooling installation 61*a* is set based on the installation length L of the adjusted cooling installation 61*a* set according to the above formula (1) or a constant installation length L of the adjusted cooling installation 61*a* that is set in advance. Specifically, the installation length L of the adjusted cooling installation 61*a* is expressed by the following formula (3). Here, when the adjusted cooling installation 61*a* includes a single-stage mist header 63 (i.e., when n is 1), as illustrated in FIG. 9, a range in which mist is jetted from the mist jet nozzles 64 at an angle θ of 45° upward and downward with respect to a direction perpendicular to the surface of the steel strip S is defined as the installation length L of the adjusted cooling installation 61*a*.

[Math. 1]

$$L = \begin{cases} (n+1) \times p & (n \geq 2) \\ 2d & (n = 1) \end{cases} \tag{3}$$

Here, p denotes a pitch between adjacent mist headers 63 in the sheet-passing direction, and d denotes a distance between the steel strip S and the mist headers 63. Based on the above formula (3), the number n of the mist headers 63 included in the adjusted cooling installation 61*a* and installation positions thereof can be determined.

In the adjusted cooling installation 61*a*, as illustrated in FIG. 7, for example, at the upstream side in the sheet-passing direction, a large number of mist jet nozzles 64 in portions corresponding to both edge portions of the steel strip S may be blocked with caps to increase the non-jetting region 63*b*, and toward the downstream side, the number of the mist jet nozzles 64 blocked with caps may be reduced from the center portion side to reduce the non-jetting region 63*b*. That is, the jetting region 63*a* in which the mist jet nozzles 64 of the mist headers 63 jet mist to the surface of the steel strip S is made larger from the upstream side toward the downstream side in the sheet-passing direction.

For example, the installation length L of the adjusted cooling installation 61*a* needed when the steel strip S has a thickness of 0.6 mm and the steel strip temperature at the entrance of the cooling zone 60 is 500° C. is set as shown in Table 1 below. A higher speed V of the steel strip S requires a longer adjusted cooling installation 61*a*.

TABLE 1

| Speed of steel strip [m/minute] | Necessary length of adjusted cooling installation [m] |
|---|---|
| 120 | 0.21 |
| 150 | 0.26 |
| 180 | 0.31 |
| 250 | 0.43 |
| 300 | 0.51 |

In this manner, overcooling of the edge portion of the steel strip S is effectively suppressed at the start of cooling, and after that the cooling range of the steel strip S is gradually widened so that the steel strip S is entirely cooled. In particular, at the start of cooling, the center portion of the steel strip S is cooled intensively and cooling of the edge portion is stopped; thus, as shown in FIG. 2, while passing through the cooling zone 60, the steel strip S can have a temperature of the edge portion equal to or higher than that of the center portion. Accordingly, at the end of cooling in the cooling zone 60, great temperature distribution in the width direction of the steel strip S is prevented, resulting in substantially uniform cooling.

In the cooling zone 60, mist is jetted from all of the mist jet nozzles 64 in the mist headers 63 at the downstream side in the sheet-passing direction with respect to the adjusted cooling installation 61*a*, that is, in all of the mist headers 63 in the (n+1)-th and the following stages of the cooling-zone preceding stage section 61 and in the cooling-zone subsequent stage section 62.

Note that the adjusted cooling installation 61*a* does not have to be installed from the first mist header 63 at the most upstream side in the sheet-passing direction of the cooling zone 60 as illustrated in FIG. 6, but in order to enjoy an effect of the present invention, it is desirable that the adjusted cooling installation 61*a* be installed from a mist header 63 as close as possible to the upstream side, if possible, the first mist header 63.

Moreover, as illustrated in FIGS. 6 and 7, the mist suction installations 67 are provided to face the edge portions of the steel strip S at the downstream side of the cooling-zone preceding stage section 61 and the downstream side of the cooling-zone subsequent stage section 62. These mist suction installations 67 suck a predetermined amount of mist jetted from the mist headers 63 according to a pressure value measured by the pressure gauge 69 to make the pressure value in the center portion negative. Thus, inside the cooling-zone preceding stage section 61, mist is present in an amount with which the steel strip can be cooled sufficiently while occurrence of dripping water is prevented, and this prevents occurrence of cooling unevenness due to dripping water.

The configuration of the adjusted cooling installation 61*a* in FIGS. 6 and 7 is an example, and a configuration of the adjusted cooling installation 61*a* of the cooling zone 60 according to the present embodiment is not limited to such an example. For example, a configuration may be adopted in which the mist jet nozzles 64 blocked with the caps 65 in FIGS. 6 and 7 are originally not provided so that cooling of the edge portion is stopped. Alternatively, instead of completely stopping cooling of the edge portion, the edge portion may be sprayed with a smaller amount of water than the center portion is. Moreover, although the adjusted cooling installation 61*a* in FIGS. 6 and 7 is configured in a manner that a cooling range of the center portion of the steel strip S becomes larger from the upstream side toward the downstream side in the sheet-passing direction, a cooling range of the center portion by the adjusted cooling installation 61*a* may be constant.

Description has been given above on the cooling zone 60 of the galvannealing furnace in the hot-dip galvannealing treatment installation according to the present embodiment. The cooling zone 60 of the galvannealing furnace according to the present embodiment includes, at the upstream side in the sheet-passing direction of the cooling-zone preceding stage section 61, the adjusted cooling installation 61*a* in which the amount of mist jetted to the steel strip S passing through the cooling zone 60 is adjusted in the width direction of the steel strip S. In the adjusted cooling installation 61*a*, the center portion of the steel strip S is actively cooled, whereas cooling of the edge portion is stopped or performed by jetting with a small amount of water. In addition, the pair of mist suction installations 67 is provided at least near portions facing the edge portions of the steel strip S in the cooling zone 60.

Here, the installation length L of the adjusted cooling installation 61*a* is set to a length such that occurrence of temperature unevenness due to great temperature deviation in the width direction of the steel strip S is prevented and, at the same time, cooling can be performed in a manner that the sheet temperature of the steel strip S does not become equal to or lower than the quench temperature Tq. This enables stable cooling of the steel strip S. The cooling zone 60 of the galvannealing furnace according to the present embodiment can cool the steel strip stably by mist cooling; thus, the steel strip can be passed at high speed to be treated, which improves productivity. In addition, providing the mist suction installations 67 at the above-described positions makes it possible to more effectively suck excessive mist that may cause dripping water in the edge portions.

EXAMPLES

As Examples, in a cooling zone of a galvannealing furnace in a hot-dip galvannealing treatment installation, a hot-dip galvanized steel strip was cooled with the number of headers used in an adjusted cooling installation changed and the installation length L of the adjusted cooling installation changed, and width-direction temperature distribution of the steel strip after cooling and appearance quality of a product were studied. The cooling zone has a configuration similar to that of FIG. 6, and includes mist headers of 36 stages. Of these, mist headers in the first to ninth stages form the adjusted cooling installation. In Examples, the water amount in the edge portion of the adjusted cooling installation was zero, and mist jetting was performed only in the center portion. Results are shown in Table 2.

In Table 2, a temperature difference at a cooling-zone intermediate position refers to a position between the cooling-zone preceding stage section 61 and the cooling-zone subsequent stage section 62, and indicates a value obtained by subtracting the temperature of the center portion from the temperature of the edge portion. A temperature difference at the cooling-zone exit side also indicates a value obtained by subtracting the temperature of the center portion from the temperature of the edge portion. The temperature of the edge portion is a surface temperature at a position 100 mm away from the end in the width direction of the steel strip, and the temperature of the center portion is a surface temperature at a center position in the width direction of the steel strip.

TABLE 2

| No | Steel strip speed [m/minute] | Sheet thickness [mm] | Cooling-zone entrance sheet temperature [° C.] | Installation length of adjusted cooling installation [m] | Lower limit value of installation length of adjusted cooling installation [m] | Presence or absence of mist suction installations | Number of headers | | Temperature difference [° C.] | | Presence or absence of roll zinc powder pick-up | Presence or absence of wrinkles |
|---|---|---|---|---|---|---|---|---|---|---|---|---|
| | | | | | | | Preceding stage | Subsequent stage | Cooling-zone intermediate position | Cooling-zone exit side | | |
| Comparative Example 0 | 150 | 0.85 | 550 | 0 | 0.28 | absent | 27 | 18 | −34 | −95 | C | C |

TABLE 2-continued

| No | Steel strip speed [m/minute] | Sheet thickness [mm] | Cooling-zone entrance sheet temperature [° C.] | Installation length of adjusted cooling installation [m] | Lower limit value of installation length of adjusted cooling installation [m] | Presence or absence of mist suction installations | Number of headers: Preceding stage | Number of headers: Subsequent stage | Temperature difference [° C.]: Cooling-zone intermediate position | Temperature difference [° C.]: Cooling-zone exit side | Presence or absence of roll zinc powder pick-up | Presence or absence of wrinkles |
|---|---|---|---|---|---|---|---|---|---|---|---|---|
| Comparative Example 1 | 150 | 0.85 | 550 | 0 | 0.28 | present | 27 | 18 | −32 | −55 | B | A |
| Example 1 | 150 | 0.65 | 480 | 1.4 | 0.31 | present | 27 | 18 | 26 | 10 | A | A |
| Example 2 | 180 | 0.55 | 520 | 1.6 | 0.25 | present | 28 | 27 | 37 | 4 | A | A |
| Example 3 | 250 | 0.70 | 600 | 1.8 | 0.31 | present | 36 | 36 | 88 | 10 | A | A |
| Comparative Example 2 | 150 | 0.60 | 480 | 0.4 | 0.29 | absent | 27 | 18 | −20 | −82 | C | C |
| Comparative Example 3 | 180 | 0.85 | 600 | 0.2 | 0.27 | present | 27 | 27 | 3 | −46 | B | C |
| Comparative Example 4 | 250 | 1.00 | 600 | 0.2 | 0.44 | present | 27 | 36 | −6 | −95 | C | C |
| Comparative Example 5 | 180 | 0.80 | 520 | 0.2 | 0.37 | present | 27 | 27 | −21 | −55 | C | C |
| Comparative Example 6 | 180 | 0.55 | 520 | 1.6 | 0.25 | present | 28 | 27 | −17 | −50 | C | C |

A: absent (excellent),
B: slightly present (inacceptable),
C: present (inacceptable)

Comparative Example 0 is an example in which mist headers in the first to ninth stages serving as the adjusted cooling installation were not used, that is, the steel strip was subjected to mist cooling entirely in the width direction. In Comparative Example 0, mist suction installations were also not used. In this case, the sheet temperature of the edge portion greatly decreased relative to the center portion in the width direction of the steel strip. A top roll picked up zinc powder on the surface of the steel strip, and wrinkles occurred. Comparative Example 1 is an example in which mist suction installations were installed in addition to the state of Comparative Example 0. In this case, wrinkles did not occur, but pick-up of zinc powder on the surface of the steel strip by a top roll was observed.

Examples 1 to 3 are examples in which mist headers in the first to ninth stages serving as the adjusted cooling installation were used. The length of the adjusted cooling installation in Examples 1 to 3 was set to be longer than its lower limit value so as to satisfy the above formula (1). In these cases, the center portion in the width direction of the steel strip was actively cooled by the adjusted cooling installation, and then the steel strip was subjected to mist cooling entirely in the width direction by mist headers at the downstream side by the adjusted cooling installation; thus, a reduction in the temperature of the edge portion was alleviated in comparison with Comparative Examples 0 and 1. A top roll did not pick up zinc powder on the surface of the steel strip, and wrinkles did not occur.

Comparative Example 2 is an example in which mist headers in the first to ninth stages serving as the adjusted cooling installation were used, the length of the adjusted cooling installation satisfied the above formula (1), and mist suction installations were not provided. In this case, as in Comparative Example 0, the sheet temperature of the edge portion greatly decreased relative to the center portion in the width direction of the steel strip. A top roll picked up zinc powder on the surface of the steel strip, and wrinkles occurred.

Comparative Examples 3 to 5 are examples in which the number of mist headers in the first to ninth stages serving as the adjusted cooling installation was reduced. In each of these examples, the length of the adjusted cooling installation did not satisfy the above formula (1) and was set to be shorter than its lower limit value. In Comparative Example 3, a top roll slightly picked up zinc powder on the surface of the steel strip because the above formula (1) was not satisfied. This is presumably because, although the temperature of the steel strip did not fall below the quench temperature during cooling, the temperature of the center portion in the width direction of the steel strip at the cooling-zone intermediate position was only slightly higher than the temperature of the edge portion, which resulted in a large temperature difference at the cooling-zone exit side.

Comparative Examples 4 and 5 are examples in which, in order to suppress the influence of the reduction in the number of mist headers used in the adjusted cooling installation resulting in a smaller temperature difference resolution allowance between the center portion and the edge portion, an attempt was made to reduce the temperature difference between the center portion and the edge portion at the cooling-zone exit side by increasing the amount of water supplied to each mist header of the adjusted cooling installation. In Comparative Example 4, the temperature difference between the center portion and the edge portion at the cooling-zone exit side was reduced, but the temperature of the steel strip fell below the quench temperature during cooling, which caused wrinkles. In Comparative Example 5, the temperature difference between the center portion and the edge portion was not able to be made sufficiently small by the increase in the amount of water supplied to each mist header of the adjusted cooling installation. This resulted in high temperature of the center portion in the width direction of the steel strip at the cooling-zone exit. On the other hand, the temperature of the edge portion in the width direction of the steel strip decreased to fall below the quench temperature. Consequently, in Comparative Example 5, a top roll picked up zinc powder on the surface of the steel strip, and wrinkles occurred.

Figure 10:
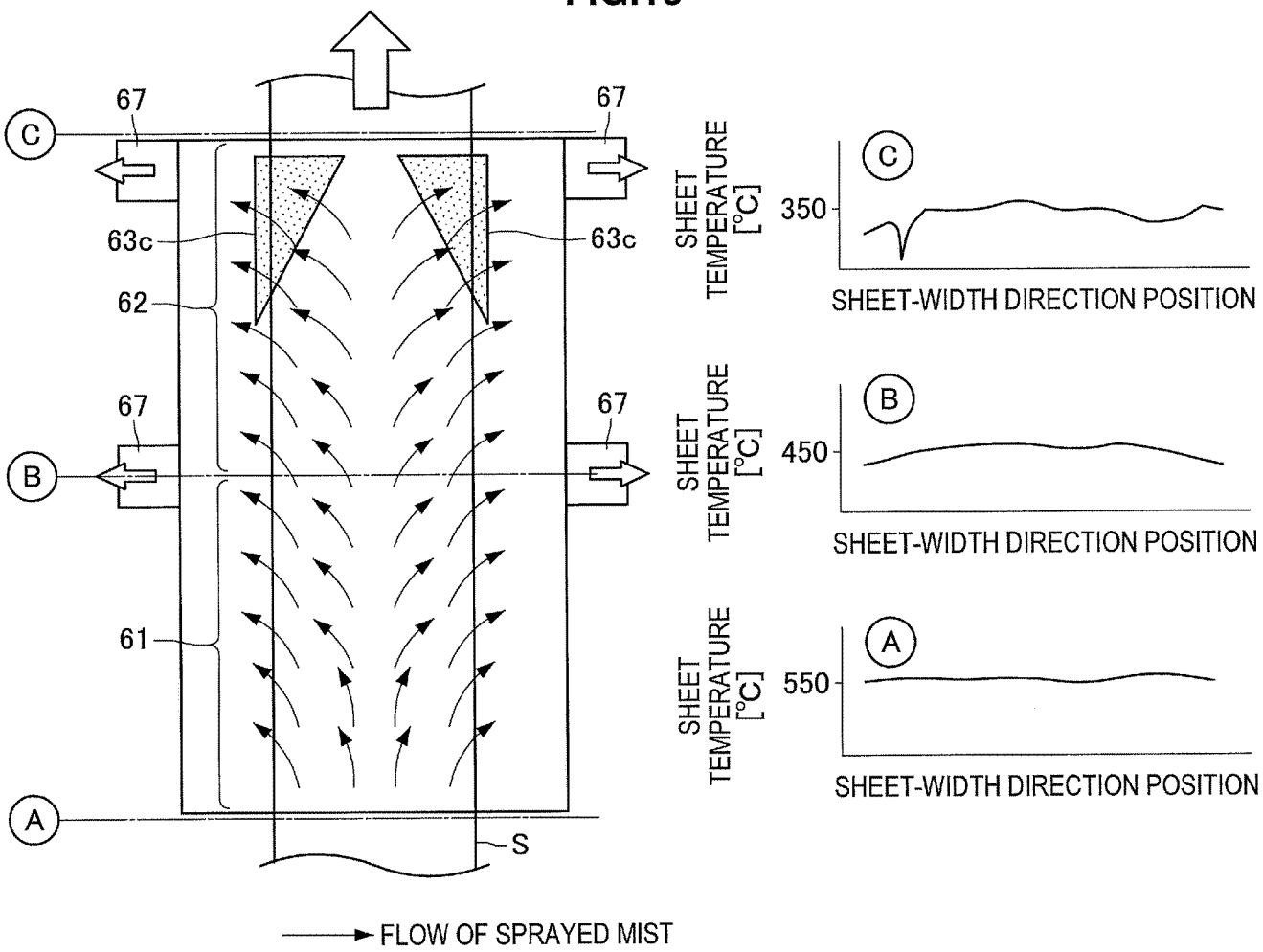
FIG. 10 is an explanatory diagram showing sheet temperature distribution in the width direction and the longitudinal direction of a steel strip passing through a cooling zone when, as Comparative Example 6, an adjusted cooling installation is provided from the final stage side of a cooling zone.

Comparative Example 6 is an example in which the adjusted cooling installation is provided at the final stage side of the cooling zone. In Comparative Example 6, the length of the adjusted cooling installation satisfied the above formula (1), and mist suction installations were installed. That is, as illustrated in FIG. 10, the cooling zone is provided with the pair of mist suction installations 67 arranged to face the edge portions in the width direction of the steel strip S. The mist suction installations 67 are provided at an intermediate position in the sheet-passing direction and the exit side of the cooling zone 60 to suck at least part of the mist jetted to the steel strip S. In addition, the adjusted cooling installation is configured from the cooling-zone exit side toward the upstream side in the sheet-passing direction. The adjusted cooling installation can be configured by blocking, with caps, the mist jet nozzles at the edge portion sides in the width direction of the steel strip S to prevent the mist jet nozzles from jetting mist. Here, a non-jetting region 63*c* is made to become smaller from the cooling-zone exit side toward the upstream side in the sheet-passing direction.

In Comparative Example 6, the steel strip S was cooled entirely in the width direction in the cooling-zone preceding stage section 61, so that at the intermediate position of the cooling zone, the temperature of the edge portion in the width direction of the steel strip became lower than the temperature of the center portion. Consequently, unstable transition boiling of the edge portion was not able be avoided by suppressing cooling of the edge portion in the cooling-zone subsequent stage section 62; thus, a top roll picked up zinc powder on the surface of the steel strip, and wrinkles occurred.

According to Examples, it was found that when an adjusted cooling installation is provided at the upstream side in the sheet-passing direction of a cooling installation and the above formula (1) is satisfied, a reduction in the temperature of the edge portion in the width direction of a steel strip is alleviated and occurrence of temperature unevenness is suppressed, and an excellent product without wrinkles can be produced. In addition, it was demonstrated that pick-up of zinc powder on the surface of the steel strip by a top roll can be prevented.

The preferred embodiment(s) of the present invention has/have been described above with reference to the accompanying drawings, whilst the present invention is not limited to the above examples. A person skilled in the art may find various alterations and modifications within the scope of the appended claims, and it should be understood that they will naturally come under the technical scope of the present invention.

For example, in the above embodiment, a mist nozzle (two-fluid nozzle) that jets mist is used in a cooling installation for cooling a steel strip, but the present invention is not limited to such an example. For example, the cooling installation may be configured using a single-fluid nozzle that jets water. In terms of water quality management, it is preferable to use a two-fluid nozzle rather than a single-fluid nozzle which makes water quality management difficult.

REFERENCE SIGNS LIST

5 molten zinc
10 zinc pot
20 sink roll
30 gas nozzle
40 heating zone
50 heat-retaining zone
60 cooling zone
61 cooling-zone preceding stage section
62 cooling-zone subsequent stage section
63 mist header
63*a* jetting region
63*b* non-jetting region
64 mist jet nozzle
65 control apparatus
70 top roll
S steel strip

The invention claimed is:

1. A method for cooling a steel strip by mist cooling in a cooling installation of a galvannealing furnace configured to perform galvannealing treatment on a hot-dip galvanized steel strip, the method comprising:

by an adjusted cooling installation provided at an upstream side in a sheet-passing direction of the cooling installation, jetting mist to the steel strip passing through the cooling installation in a manner that an amount of mist jetted to the steel strip passing through the cooling installation is smaller in an edge portion in a width direction of the steel strip than in a center portion;

by a mist suction installation provided at least at a downstream side in the sheet-passing direction of the cooling installation, sucking at least part of mist jetted to the steel strip; and cooling the steel strip at a sheet-passing speed such that, during a period between start and end of cooling of the steel strip, a temperature of the steel strip is within a film boiling temperature range and a temperature of the edge portion in the width direction of the steel strip is equal to or higher than a temperature of the center portion in at least a range of ⅔ or more from the upstream side in the sheet-passing direction of a total cooling length of the cooling installation.

2. The method for cooling a steel strip according to claim 1, wherein, with respect to an installation length L [m] of the adjusted cooling installation, a speed of the steel strip is set to be equal to or less than an upper limit speed $V_{max}$ [m/s] calculated using a formula (a) below, $$V_{max}=(L\times(T_{in}-\beta')\hat{}\,m\times(T_{in}-\gamma'))/(\alpha'\times th) \quad \text{(a)},$$

where $T_{in}$ [° C.] denotes a temperature of the center portion of the steel strip at an entrance of the cooling installation, th [m] denotes a thickness of the steel strip, and α', β', γ', and m are constants set according to a hot-dip galvannealing installation.

3. The method for cooling a steel strip according to claim 2, wherein the constants are set as follows: α'=1870000, β'=330, γ'=45, m=0.6.

4. A cooling installation by mist cooling of a galvannealing furnace configured to perform galvannealing treatment on a hot-dip galvanized steel strip, the cooling installation comprising:

an adjusted cooling installation provided at an upstream side in a sheet-passing direction of the cooling installation, the adjusted cooling installation being capable of adjusting, in a width direction of the steel strip, an amount of mist jetted to the steel strip passing through the cooling installation;

a mist suction installation provided at least at a downstream side in the sheet-passing direction of the cooling installation, the mist suction installation being configured to suck at least part of mist jetted to the steel strip, and a control apparatus configured to control the adjusted cooling installation and the mist suction installation, wherein the adjustment cooling installation includes, in the sheet-passing direction, a plurality of headers each including a plurality of mist jet nozzles arranged along the width direction, the adjusted cooling installation is provided in a manner that an installation length L [m] of the adjusted cooling installation in the sheet-passing direction of the steel strip satisfies a formula (b) below, the adjusted cooling installation is adjusted in a manner that an amount of mist jetted from the plurality of mist jet nozzles to the steel strip passing through the cooling installation is smaller in an edge portion in the width direction of the steel strip than in a center portion by stopping cooling of the edge portion or that the edge portion is sprayed with a smaller amount of water than the center portion is, the control apparatus adjusts the water amount of the header by controlling opening and closing valves of the header including a plurality of mist jet nozzles, the control apparatus controls the amount of mist sucked by the mist suction installations to adjust damper opening of exhaust blowers based on a pressure value is measured by a pressure gauge provided near a mist suction port, and a control apparatus control such that, during a period between start and end of cooling of the steel strip, a temperature of the steel strip is within a film boiling temperature range and a temperature of the edge portion in the width direction of the steel strip is equal to or higher than a temperature of the center portion in at least a range of ⅔ or more from the upstream side in the sheet-passing direction of a total cooling length of the cooling installation $$L \geq (\alpha \times V \times th)/((T_{in}-\beta)\hat{}m) \times (T_{in}-\gamma)) \quad \text{(b)}$$

where $T_{in}$ [° C.] denotes a temperature of the center portion of the steel strip at an entrance of the cooling installation, V ⌊m/s⌋ denotes a speed of the steel strip, th [m] denotes a thickness of the steel strip, and α, β, γ, and m are constants set according to a hot-dip galvannealing installation.

5. The cooling installation according to claim 4, wherein α=1700000, β=330, γ=45, m=0.6.

6. The cooling installation according to claim 4, wherein each header is configured in a manner that mist is not jetted to the steel strip in the edge portion in the width direction of the steel strip.

7. The cooling installation according to claim 6, wherein each header of the adjusted cooling installation is configured in a manner that the number of the nozzles that jet mist to the steel strip in the center portion in the width direction of the steel strip increases from the upstream side toward the downstream side in the sheet-passing direction.

8. The cooling installation according to claim 5, wherein each header is configured in a manner that mist is not jetted to the steel strip in the edge portion in the width direction of the steel strip.

9. The cooling installation according to claim 8, wherein each header of the adjusted cooling installation is configured in a manner that the number of the nozzles that jet mist to the steel strip in the center portion in the width direction of the steel strip increases from the upstream side toward the downstream side in the sheet-passing direction.

* * * * *